United States Patent [19]

Beltz

[11] Patent Number: 4,917,017

[45] Date of Patent: Apr. 17, 1990

[54] MULTI-STRAND IGNITION SYSTEMS

[75] Inventor: Donald R. Beltz, Allentown, Pa.

[73] Assignee: Atlas Powder Company, Dallas, Tex.

[21] Appl. No.: 200,031

[22] Filed: May 27, 1988

[51] Int. Cl.[4] ..... F42B 5/16

[52] U.S. Cl. ..... 102/470; 102/275.1; 102/275.9

[58] Field of Search ..... 102/275.1, 275.8, 275.5, 102/275.9, 275.6, 275.4, 332, 470, 520, 521

[56] References Cited

U.S. PATENT DOCUMENTS

| | | | |
|---|---|---|---|
| 4,957 | 2/1847 | Bacon | 102/275.1 |
| 481,012 | 8/1892 | Doyle | 102/275.1 |
| 927,968 | 7/1909 | Harlé | 102/275.1 |
| 2,113,004 | 4/1938 | Snelling | 102/275.8 |
| 2,239,052 | 4/1941 | Pearsall et al. | 102/275.1 |
| 2,498,050 | 2/1950 | Selvidge | 102/275.8 |
| 2,877,708 | 3/1959 | Rey | 102/275.8 |
| 2,923,239 | 2/1960 | Andrew et al. | 102/275.4 |
| 3,173,370 | 3/1965 | Landry et al. | 102/275.5 |
| 3,320,883 | 5/1967 | Welsh | 102/275.8 |
| 4,220,087 | 9/1980 | Posson | 102/275.6 |
| 4,232,606 | 11/1980 | Yunan | 102/275.8 |
| 4,290,366 | 9/1981 | Janoski | 102/202.3 |
| 4,763,577 | 8/1988 | Romer et al. | 102/430 |
| 4,823,699 | 4/1989 | Farinacci | 102/521 |

FOREIGN PATENT DOCUMENTS 728240 6/1980 United Kingdom .

*Primary Examiner*—David H. Brown
*Attorney, Agent, or Firm*—Richards, Medlock & Andrews

[57] ABSTRACT

Linear ignition tube suitable for the ignition of long propellant beds. The tube comprises an elongated tubular member having a ratio of interior diameter to wall thickness of at least 4. The ignition tube is provided with a plurality of ignition strands formed of an oxidizable ignition material at a density of at least 2 strands/0.001 in$^2$ of a cross-sectional area of the tubular member. The ignition strands provide a linear ignition rate for the tube within the range of 3000–6000 ft/sec. The tube can contain from 30–50 ignition strands formed of a self-oxidizing ignition material such as nitrocellulose fibers coated with a mixture of an oxidizing component such as a mixture of ammonium perchlorate and a fuel component such as aluminum. An ignition transmission system comprises a plurality of ignition tubes which extend in a longitudinal conjoint relationship in which one tubular member at least overlaps partially another. The walls of the tubular members are sufficiently thin so that, upon ignition of the ignition strands within one tubular member, communication of the ignition reaction from the first tubular member is transmitted to the ignition strands of the other tubular member. The ignition system is useful in elongated propellant charges such as ordnance cartridges.

36 Claims, 2 Drawing Sheets

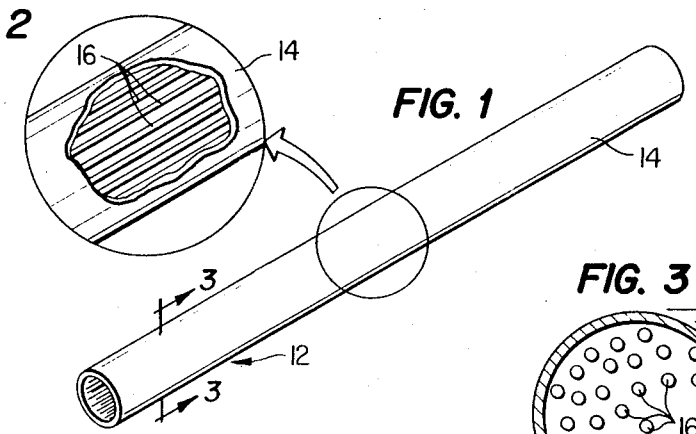
FIG. 1
FIG. 2
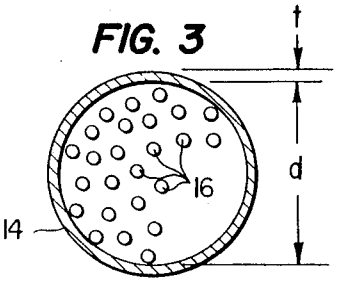
FIG. 3
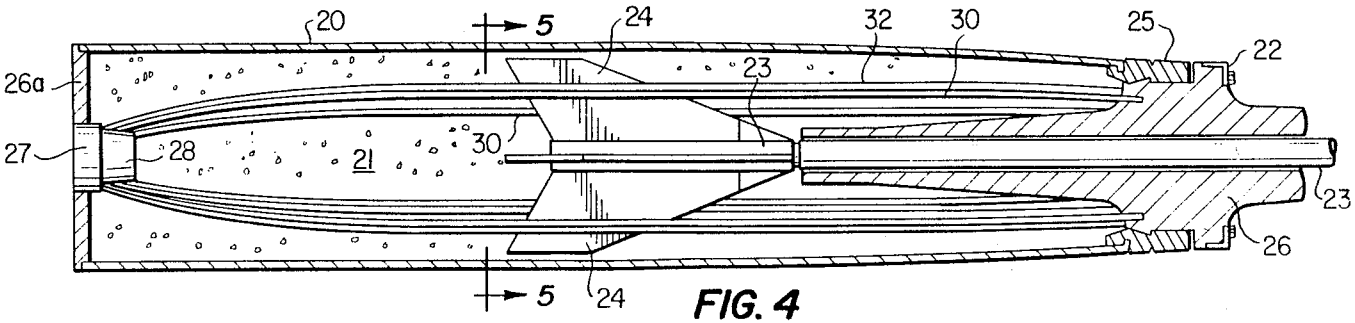
FIG. 4
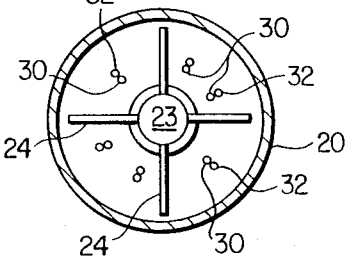
FIG. 5
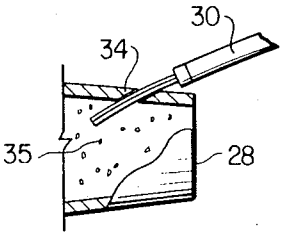
FIG. 7

MULTI-STRAND IGNITION SYSTEMS

FIELD OF THE INVENTION

This invention relates to ignition systems and more particularly to multi-strand ignition tubes and their use in the ignition of propellant charges.

BACKGROUND OF THE INVENTION

Various systems are available for the ignition or detonation of propellant and explosive charges. In addition to the more conventional and older electrical or chemical ignition systems, signal tube transmission systems have been proposed for use in various applications. Signal tubes and their use in various applications are described in "Explosives and Rock Blasting," Atlas Powder Company, Dallas, Texas, 1987, at pages 139–151. Described in its simplest terms, such a signal tube comprises a tubular member which contains reactive material that transmits a firing signal through the tube upon initiation by any suitable means such as electrical or chemical detonating means.

Specific low brisance energy transmission devices of the type employing signal tubes are disclosed in U.S. Pat. No. 4,290,366 to Janoski. Among the transmission devices disclosed in Janoski are elongated tubular members formed of polymeric materials which contain filaments of a self-oxidizing material such as nitrocellulose. The guide tube may be formed of a material such as polyethylene, polypropylene, polyvinylchloride, polybutene, ionomers, nylons and the like, and the strands of self-oxidizing material can be in the form of a mono-filaments or multi-filaments such as woven or spun threads. Any suitable self-oxidizing material which is capable of propagating an explosive signal through the elongated plastic tube without rupturing the tube can be employed. The self-oxidizing material may be unmodified nitrocellulose or a chemically modified nitrocellulose such as a halogenated derivative. Alternative self-oxidizing materials include filaments extruded or molded from flexible plasticized explosives compositions containing RDX, HMX or the like. The strands of self-oxidizing material can also be coated with modifying material such as flaked or atomized aluminum, RDX, HMX, PETN and similar materials.

U.S. Pat. No. 4,220,087 to Posson discloses a linear ignition fuse for use in gas generators and the like. The ignition fuse of Posson comprises a core of nondetonating ignitive material comprising a mixture of particulate fuel, oxidant and binder disposed within a frangible tubular sheath formed of materials such as plastic, metal, ceramic or composite material. Various core materials are disclosed in Posson and include a plurality of strands formed of materials such as glass fibers, metals, or polymeric materials coated with an ignitive mixture of powdered fuel, oxidant and a suitable binder. Fuels disclosed in Posson include aluminum, magnesium, titanium, boron and zirconium/nickel alloy, and oxidants include alkali metal, alkaline earth metal or ammonium nitrates, polychromates or perchlorates, including specifically potassium and ammonium perchlorate.

In the Posson system, the reaction travels down the fuse at a velocity of about 1000–1500 meters/sec, and the sheath is shattered, projecting small incandescent particles radially from the fuse. Reinforcing strands formed of fiberglass or metal wire may be wrapped about the outer surface of the sheath and spaced to leave unreinforced areas in order to distribute the effect of the reaction in rupturing the sheath. The Posson system, like the Janoski system, provides for a low brisance energy transmission system. As described in Posson, a length of the fuse was taped to an unsupported 0.040" sheet of soft aluminum and ignited with no visible deformation of the aluminum sheet.

SUMMARY OF THE INVENTION

In accordance with the present invention, there is provided a linear ignition tube which is especially suitable for the ignition of long propellant beds and the like and which is highly effective and leaves a minimal amount of adverse residue. In one aspect of the invention, there is provided an elongated tubular member which is consumable under ignition conditions. The tubular member is dimensioned in its wall thickness and interior diameter to provide a ratio of interior diameter to wall thickness of at least 4. The ignition tube is provided with a plurality of ignition strands extending through the tubular member. The ignition strands are formed of any suitable oxidizable ignition material and are sufficient in number to provide a density of at least 1.5 strands/0.001 inch$^2$ of a cross-sectional area of the tubular member. More preferably, a sufficient number of ignition strands are employed to provide a density of at least 2 strands/0.001 inch$^2$ of cross-sectional area of the tubular member. The ignition strands provide a linear ignition rate for the tube within the range of 3000–6000 ft/sec. In a preferred embodiment of the invention, the tube contains from 30–50 ignition strands. In a further aspect of the invention, the ignition strands are formed of a self-oxidizing ignition material, preferably nitrocellulose. In yet a further aspect of the invention, the ignition strands comprise fibers of nitrocellulose which are coated with a mixture of an oxidizing component and a fuel component. The oxidizer component preferably includes ammonium perchlorate and the fuel component includes aluminum. The oxidizer component may comprise a mixture of ammonium perchlorate and an alkali metal perchlorate such as sodium perchlorate.

In a further embodiment of the invention, an ignition transmission system comprises a plurality of ignition tubes as described above which extend in a longitudinal conjoint relationship in which the outer surface of at least one tubular member overlaps at least partially the outer surface of another tubular member. The walls of the tubular members are sufficiently thin so that, upon ignition of the ignition strands within one tubular member, communication of the ignition reaction from the first tubular member is transmitted to the ignition strands of the other tubular member.

In yet another embodiment of the invention, there is provided an ignition system for an elongated propellant charge such as an ordnance cartridge. An ignition source is provided at one end of the propellant charge. A plurality of elongated ignition tubes extend longitudinally within the charge. Each of the ignition tubes comprises an elongated tubular member as described previously and has a plurality of strands of oxidizable ignition material extending therethrough to provide a linear ignition rate for the ignition tube within the range of 3000–6000 ft/sec. At least one of the tubes is a primary ignition tube connected to the ignition source and extending from the source into the propellant charge. At least another of the ignition tubes is in a longitudinal conjoint relationship to the primary tube so that the tubes at least partially overlap and contact one another. The walls of the tubes are sufficiently thin to permit propagation of the ignition reaction from the ignition strands in the primary tube to the ignition strands in the other tube.

BRIEF DESCRIPTION OF THE DRAWINGS

FIG. 1 is a perspective view of a linear ignition tube embodying the present invention;

FIG. 2 is an enlarged view with parts broken away showing a portion of the ignition tube of FIG. 1;

FIG. 3 is a sectional view of the ignition tube taken along line 3—3 of FIG. 1;

FIG. 4 is a side elevation, partly in section of a propellant containing ordinance cartridge incorporating an ignition transmission system in accordance with the present invention;

FIG. 5 is a sectional view taken along line 5—5 of FIG. 4;

FIG. 7 is a sectional view showing a portion of an adapter utilized in the ignition system of FIG. 4;

DETAILED DESCRIPTION

Figure 6:
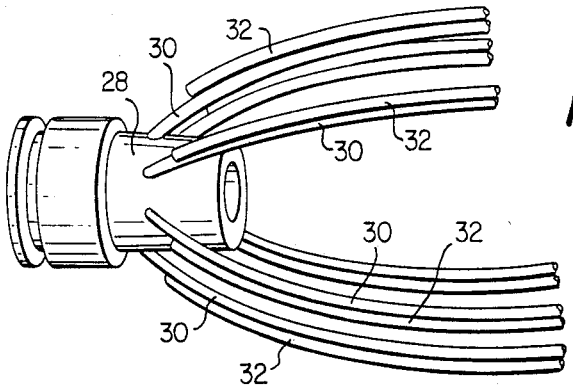
FIG. 6 is a idealized perspective view of a portion of the ignition transmission system of FIG. 4.

The present invention provides linear ignition tubes which are highly reliable and sympathetically ignitable from one tube to the next and yet of such low brisance as to avoid untenable disruption of propellant grains. In addition, the tubes can be configured to provide little or no residue, and thus are particularly useful in ignition systems for ordnance propellant charges. Accordingly, the invention will be described in detail in connection with its use in such ordnance ignition systems. However, it is to be recognized that the invention will find application in various signal transmission and ignition systems, both military and non-military, especially where rapid and near simultaneous ignition of propellant charges and the like is desirable. In ordnance, such as armor-piercing 105 mm anti-tank ammunition, a conventional ignition system involves the use of a bayonet-type primer which runs through the center of the propellant cartridge. A typical bayonet-type primer is from about ½"1 in diameter and runs from the primer head at the base of the propellant cartridge into the cartridge along the axis thereof. Typically, the bayonet primer is a metal tube having flash holes along the length thereof and filled with an ignition material such as benite.

Proposed armor-piercing ammunition, still in the experimental stage, incorporates LOVA (low vulnerability ammunition) propellants which are generally more difficult to ignite than conventional granular propellants. Such ignition difficulty is due to several factors including relatively high ignition temperatures and slow flame spread characteristics. For example, a commonly employed propellant, JA-2, has an ignition temperature as measured by TGA (thermal gravimetric analysis) of about 200° C. LOVA propellants are characterized by ignition temperatures of about 225° C. (TGA) or higher. The flame spread characteristics of LOVA propellants are also lower, on the order of about ½–¾that of conventional propellants. Another complicating factor involves the use of relatively long penetrators in fin stabilized sabot ordnance. Such penetrators limit the space available for a conventional bayonet primer. For the proposed LOVA propellants and also for the conventional propellants which are more readily ignitable than the LOVA propellants, the shortened primer, termed a "stub" primer, can seriously degrade propellant ignition and ammunition performance. Non-ideal ignition of the propellant charge is particularly serious in munitions applications because it can lead to unpredictable performance characteristics, shorten the useful life of the gun, or, in the worst case, result in a catastrophic event.

The present invention can be used to provide ignition systems for such modern ammunition as described above which enables reliable and near simultaneous ignition of the propellant surfaces within the cartridge. The invention minimizes undesirable localized base ignition which can lead to excessive variability of ignition velocity and chamber overpressurization within the gun.

In its simplest form, the present invention comprises an ignition tube which includes an elongated tubular member which can either be flexible or rigid and which contains a plurality of energetic ignition strands. Upon ignition from a suitable ignition source, the ignition strands produce sufficient energy in the form of heat, plasma, particulates and gases to ignite the propellant charge in which the ignition tube is used. More particularly, and referring to FIGS. 1, 2 and 3, there is illustrated an ignition tube 12 comprising an elongated tubular member 14 formed of a material and dimensioned such that it is substantially consumable under ignition conditions. The tubular member 14 may be formed of any suitable material, but typically will take the form of a thermoplastic polymer such as polyethylene, polypropylene, polybutylene and nylon. Other thermoplastic polymers such as polyvinylchloride can also be used in various applications where substantial amounts of toxic fumes evolved during decomposition are not of significance or can be scavenged as described below. A preferred material for use in formulating the ignition tubes is low density polyethylene, since it has a sufficiently high melting point and tensile strength to retain its integrity during handling and storing of the ammunition, and yet is readily consumable during the ignition process.

The ignition tube also contains a plurality of ignition strands 16 extending through the tubular member. The ignition strands may be formed of any suitable oxidizer material which provide the desired linear ignition rate for the tube, within the range of 3000–6000 ft/sec, and which are sufficiently energetic at the density of strands within the tube to substantially disrupt the tubular member. As described below, the number and energy of the strands and the wall thickness of the tubular member desirably are such as to provide for sympathetic ignition of the ignition strands of an adjacent tubular member. The ignition strands preferably are formed of a self-oxidizable ignition material, i.e. material which does not rely upon extraneous oxygen to sustain ignition. Ignition of the self-oxidizing ignition material may be due to chemically-internal oxidization-reduction reactions, as in the case of the preferred ignition material, nitrocellulose, or may be due to so-called external oxidation-reduction reactions as in the case of mixtures of organonitric compounds such as RDX or HMX and oxidizers such as ammonium perchlorate. As in the preferred embodiments described below, both external and internal oxidation-reduction reactions may be employed to provide the self-oxidizing ignition.

The ignition strands can be in the form of mono-filaments or multi-filaments and can be either continuous throughout the tubular member or intermittent but with overlapping strands. As a practical matter, it usually will be preferred to employ continuous strands both from the viewpoint of ensuring reliability in ignition of the tubular member and also for reasons of economy and ease of fabrication of the ignition tubes.

The preferred ignition strands comprise nitrocellulose, and more particularly, nitrocellulose fibers having an oxidizing component and a fuel component incorporated thereon. Suitable oxidizing agents include alkali metal and ammonium perchlorates and a suitable fuel includes aluminum. Especially preferred ignition strands comprise nitrocellulose fibers coated with an oxidizer-fuel mixture comprising ammonium perchlorate, aluminum and manganese dioxide with the fiber and the energetic coating components being in approximately equal amounts. Instead of manganese dioxide, other suitable metal oxides can be employed including metal oxides of lead, iron and copper. Manganese dioxide is preferred in ordnance applications in which ammonium perchlorate is used as an oxidizing agent since the manganese dioxide will act not only as an oxidizing agent but also is in effect a scavenging agent for the hydrochloric acid vapors generated by reduction of ammonium perchlorate. The above-identified metal oxides will also function as scavenging agents.

Where ammonium perchlorate and an aluminum are incorporated onto the nitrocellulose fibers, the weight ratio of ammonium perchlorate to aluminum preferably is within the range of 2–4. The weight of aluminum and ammonium perchlorate in the energetic coating is preferably at least 70% and where manganese dioxide or other scavengers are not used, can range up to 100%. The relationship between the energetic coating material and the nitrocellulose filament is preferably such as to comprise from 20–70 wt. % of fuel and oxidizer component and 30–80 wt. % of nitrocellulose.

The oxidizer salt component also may comprise a mixture of oxidizing salts based upon ammonium perchlorate and at least one alkali metal or ammonium nitrate. Exemplary of a suitable mixed oxidizer salt component is a mixture of ammonium perchlorate, ammonium nitrate and sodium nitrate, in addition to the manganese dioxide and aluminum fuel. In addition to or as a substitute for aluminum, other fuel components which can be used include magnesium, titanium, zirconium, manganese and carbon. Further, the self-oxidizing filaments disclosed in the aforementioned U.S. Pat. No. 4,290,366 to Janoski can be employed to provide the ignition strands in this invention and for a further description of such materials, the entire disclosure of the Janoski patent is incorporated herein by reference.

The relationship between the number of ignition strands in the tubular member and the configuration of the tubular member determines the characteristics of the ignition tube in terms of being consumable under ignition conditions and capable of sympathetic ignition between contacting ignition tubes. The wall of the tubular member normally is within the range of 0.005–0.025" and bears a relationship to the internal diameter of the tubular member and the number of ignition strands within the tube. In general, it will usually be possible to characterize the tubular member as having a wall thickness and interior diameter to provide a ratio of interior diameter to wall thickness of at least four. The number of ignition strands disposed in the tubular member should be such as to provide a density of ignition strands, in terms of the cross-sectional area of the internal bore of the tubular member, of at least 1.5 strands preferably 2 strands/0.001 $in^2$ of cross-sectional area. Thus, with respect to the ignition tube shown in cross-section in FIG. 3, the ratio of the internal diameter d of tubular member 14 to the wall thickness t of tubular member 14 should be at least 4, and the ratio of the number of strands 16 to the cross-sectional area, $d^2/4\pi$, should be at least 2/0.001 $in^2$ Experimental work relative to the invention was carried out employing an ignition tube comprising a tubular member formed of low density polyethylene having an internal diameter of 0.12" and an external diameter of 0.15". An ignition tube containing 20 strands of nitrocellulose coated with an energetic mixture of aluminum, ammonium perchlorate and manganese dioxide (about 52% nitrocellulose, 31% ammonium perchlorate, 10% aluminum, 7% manganese dioxide) was found upon ignition to completely shatter the tubular member but still left fragments which were identifiable as tubing fragments. A similar ignition tube of the same size but provided with 40 of the above-described ignition strands resulted upon ignition in substantially complete consumption of the tubular member. When these tubes were ignited on an open surface, all that remained were a few shreds of plastic material.

By placing two ignition tubes in contact with one another, the ignition reaction can be transferred from one tube to another. The area of contact between adjacent tubes need not be great. In experimental work carried out using a 40-strand ignition tube of the type described above, the ignition reaction was propagated along one tube and transferred to a second tube overlapping the first by a distance of about 2". In the ignition of propellant beds, the use of bundles of two or more ignition tubes offers advantages over single tubes carrying a greater number of ignition strands. In this respect, experimental work was carried out with a propellant bed about 8" long and about 2" in diameter. A single polyethylene ignition tube having dimensions of 0.165" I.D. and 0.195" O.D. containing 70 strands of nitrocellulose-based ignition strands as described above failed to ignite the propellant bed. However, a bundle of two ignition tubes (0.12" I.D. and 0.15" O.D.), each containing 40 strands, completely and uniformly ignited the propellant when the ignition charge was applied to one tube (termed the primary tube) of the tube bundle. A similar result was achieved using a larger tube equivalent in cross-sectional area and ignition strands to the combined cross-sectional area and strands of the two smaller ignition tubes, i.e., an 80-strand ignition tube formed from a tubular member having a 0.17" I.D. and a 0.2" O.D. However, the tube bundle of two smaller tubes is advantageous over a single larger tube of equivalent energy and cross-sectional area for several reasons. The tube bundle exposes a greater surface area to the propellant charge. In addition, ignition of a single relatively small primary tube of a tube bundle as described below is generally somewhat simpler than ignition of a larger tube.

FIG. 4 illustrates the application of a preferred embodiment of the invention incorporating primary and secondary ignition tubes in an ignition system for an elongated propellant charge in an ammunition cartridge 20. FIG. 5 is a transverse cross-sectional view of the cartridge of FIG. 4 and FIG. 6 is a perspective view of the ignition system for the ammunition cartridge. As shown in FIG. 4, a charge of granular propellant 21 is located within the combustible cartridge 20 of a 105 mm anti-tank round having a diameter of about 4" and a length of about 24". The anti-tank round is one which fires a fin stabilized sabot type projectile which has a penetrator rod extending into the propellant chamber. Such ammunition commonly referred to as APFSDS (armor-piercing fin stabilized discarding sabot) ordnance, comprises an elongated projectile formed of a heavy metal such as depleted uranium which is disposed in a significant portion of the propellant chamber and extends out from the front end thereof through a sabot which is discarded upon firing. More particularly, and as shown in FIG. 4, the forward end of the cartridge 20 is provided with a disposable sabot 22 which upon firing is fragmented and falls away from a penetrator rod 23. The penetrator rod 23 is provided with a plurality of fins 24 which function to stabilize the penetrating rod after it is fired from the anti-tank gun. The sabot 22 has a gauge section 25 which rides in the rifled bore of the gun and a bored out body section 26 through which the rod extends. As will be understood by those skilled in the art, the sabot disengages from the penetrating rod when it leaves the gun barrel and the fins stabilize the rod on its flight to the target. The cartridge 20 also includes a base 26*a* which contains a primer head 27. The primer head 27 can be a conventional military igniter comprising an electric match which receives an electric impulse upon a firing order to ignite a small charge of black powder. The primer head is provided with an adapter 28 for connection to primary ignition tubes configured in accordance with the present invention.

A plurality of primary ignition tubes 30, six in number as shown in FIGS. 5 and 6, extend from the adapter 28 to the front of the cartridge where they are secured in place by any suitable means. Each primary ignition tube is provided with a secondary ignition tube 32 extending along most of the length of the primary tubes to provide six tube bundles. The primary and secondary ignition tubes may be secured to one another along their lengths by any suitable means such as by mechanical ties or tape. The tubes may also be molded to provide an integral double tube structure. In a specific example configured in accordance with FIGS. 4–6, each of the six primary and six secondary ignition tubes comprise 40 strands of nitrocellulose based ignition material disposed within 0.12" I.D., 0.15" O.D. tubes formed of low density polyethylene. The nitrocellulose fibers were coated with a mixture of aluminum, ammonium perchlorate and manganese dioxide to provide ignition strands of about equal parts of nitrocellulose fibers and oxidizer-fuel coatings having a total of about 3–4 grams of ignition material per meter of tube. Ignition systems thus formulated were tested in the 105 mm anti-tank rounds and found to provide very good interior ballistic results as indicated by smooth gradients and the lack of negative pressure differentials and ignition delays of less than 8 milliseconds. Test firings employing this ignition system also showed no significant residues remaining in the gun.

FIG. 7 is an enlarged view, partly in section, showing a portion of the firing adapter and a suitable technique for securing the primary ignition tubes to the adapter. Each primary tube 30 is provided with a smaller diameter (0.05" I.D. and 0.12" O.D.) polyethylene igniter tube 34 formed of polyethylene and containing 12 strands of ignition material extending from the interior of the primary tube into the black powder charge 35 in the firing adapter 28. From the foregoing description, it will be recognized that the invention is particularly well suited for use as an ignition system in combination with discardable sabot penetrator type ordnance. The ignition tubes are readily disposed throughout the propellant chamber in a manner providing for complete and even ignition and without interference between the penetrator rod and fin assembly and the ignition system. Thus the invention offers a significant advantage over bayonet type or stub type ignition systems. It also offers substantial advantages over the alternative of using multiple metal tubes in a "candelabra" ignition system which would provide substantial quantities of metal fragments which must be extracted from the gun and handled in the tank during a firing mission.

The invention is also useful in artillery rounds where the conventional bayonet type igniters can be used. Even though there are no structural elements offering obstructions to the ignition systems, the use of the present invention offers much the same advantages as described above in securing even and complete ignition of the propellant charge and in leaving little residue behind. Also while the invention has been described in connection with its use as an igniter for military ordnance, it is to be recognized that it will find use in connection with other ignitable materials employed as propellant or gas generating charges in either military or non-military applications.

Figure 8A:
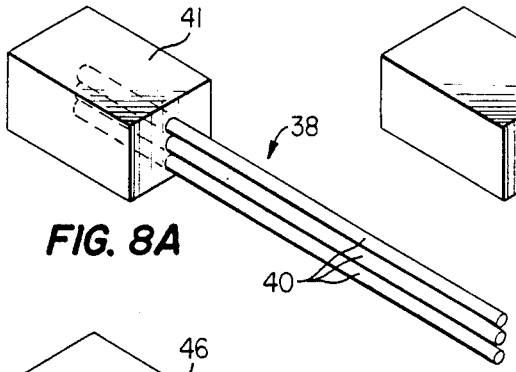
FIG. 8A is a perspective view of an ignition transmission system useful in propellant charges of small cross-sectional dimensions.
Figure 8B:
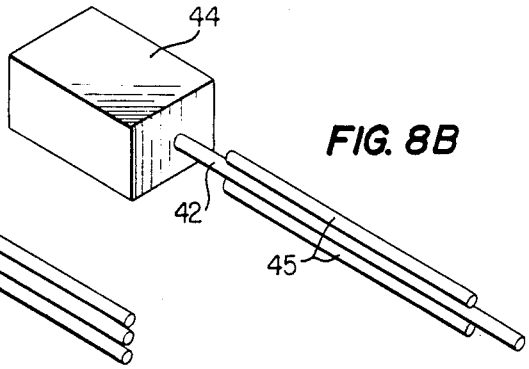
FIG. 8B is a perspective view of an ignition system similar to FIG. 8A but illustrating a tube bundle with several secondary tubes.

FIG. 8A is a perspective view of another form of ignition system which is particularly useful in combination with propellant charges of relatively small cross-sectional dimensions. As shown in FIG. 8A, a tube bundle 38 comprising three primary tubes 40 extends from an ignition source indicated schematically by reference No. 41 into a propellant charge (not shown). The three primary tubes of the tube bundle are secured together along their lengths. An alternative configuration employing a tube bundle comprising a single primary tube and two secondary tubes is illustrated in FIG. 8B. As shown in FIG. 8B, a primary tube 42 extends from ignition source 44 and two secondary tubes 45 are disposed in conjoint relationship with the primary tube to form the tube bundle.

Figure 9A:
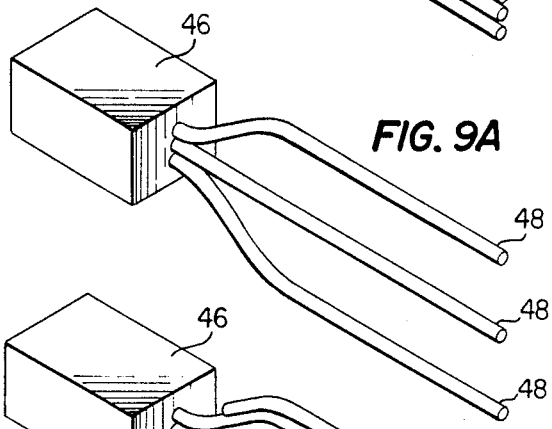
FIG. 9A is a perspective view of yet another form of an ignition transmission system embodying the present invention.
Figure 9B:
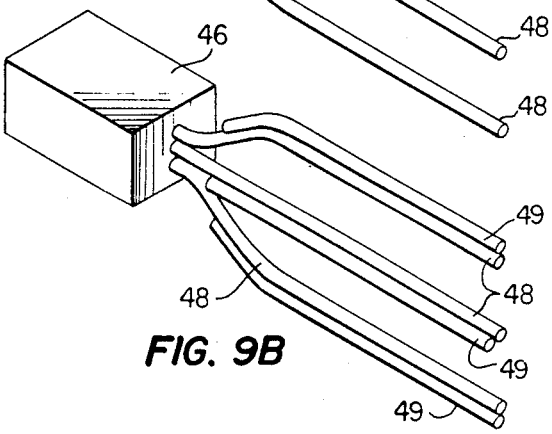
FIG. 9B is a perspective view of another embodiment of the invention incorporating a plurality of tube bundles of primary and secondary ignition tubes.

FIGS. 9A and 9B illustrate ignition systems similar to those of FIG. 8, but for use in propellant charges of somewhat larger cross-sectional dimensions. In FIG. 9A, the ignition system comprises an ignition source 46 and three primary tubes 48 extending from the source with one extending along the axis of the propellant charge (not shown) and the other two fanning out similarly as in the case of the system shown in FIG. 4. The system illustrated in FIG. 9B is similar to that of FIG. 9A except here each primary tube is provided with a secondary tube 49 to provide a plurality of tube bundles displaced from one another within the propellant charge.

Figure 10:
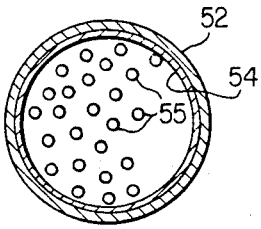
FIG. 10 is an end view of a modified form of ignition tube.

In the embodiments of the invention described thus far, the tubular members within which the energetic strands are disposed are formulated of an inert consumable material such as low density polyethylene. In a further aspect of the invention, all or part of the outer tubular member can be formed of an energetic material. In this respect, the tube 14 (FIG. 1) can be formed of an energetic thermoplastic mixture based upon nitrocellulose poly blends and suitable plasticizers to form an extrudable or moldable thermoplastic material. Alternatively, thin sheets of plastic such as Mylar polyester films can be coated with nitrocellulose based lacquer materials and then formed about the energetic strands to provide the final ignition tubes. This procedure of forming the ignition tubes is advantageous in that additional energetic additives can be incorporated into the energetic coating on the interior of the plastic tube. This embodiment of the invention is illustrated in FIG. 10 which indicates an outer plastic Mylar tubular member 52 providing structural support and an inner lining 54 formed of nitrocellulose containing a mixture of energetic oxidizer and fuel additives. Normally, the energetic additives will take the form of ammonium perchlorate and aluminum, although various other additive mixtures as described above could also be employed. The tube is provided with a plurality of ignition strands 55 similarly as described above with respect to FIGS. 1–3.

Having described specific embodiments of the present invention, it will be understood that modification thereof may be suggested to those skilled in the art, and it is intended to cover all such modifications as fall within the scope of the appended claims.

I claim:

1. In a linear ignition tube, the combination comprising:

an elongated tubular member which is substantially consumable under ignition conditions, said tubular member having a wall thickness and an interior diameter to provide a ratio of interior diameter to wall thickness of at least 4; and a plurality of ignition strands of oxidizable ignition material extending through said tubular member at a density of at least 1.5 strands/0.001 $in^2$ of cross sectional area of the internal bore of said tubular member and providing a linear ignition rate for said tube within the range of 3000–6000 ft/sec.

2. The combination of claim 1 comprising at least 20 of said ignition strands.

3. The combination of claim 1 wherein said ignition strands are formed of a self-oxidizing ignition material.

4. The combination of claim 1 wherein said ignition strands comprise fibers of nitrocellulose having an oxidizing agent incorporated thereon.

5. The combination of claim 1, wherein the density of said ignition strands is at least 2 strands/0.001 in $^2$ of a cross-sectional area of the internal bore of said tubular member.

6. The combination of claim 1 comprising from 30–50 ignition strands in said tubular member comprising fibers of nitrocellulose having a coating thereon of a mixture of an oxidizer component and a fuel component.

7. The combination of claim 6 wherein said oxidizer component includes ammonium perchlorate and said fuel component includes aluminum.

8. The combination of claim 7 wherein said oxidizer component includes a metal oxide selected from the class consisting of lead, manganese, iron and copper oxides.

9. The combination of claim 7 wherein said ignition strands comprise 30–80 wt. % of nitrocellulose and from 20–70 wt. % of fuel and oxidizer components.

10. The combination of claim 9 wherein said oxidizer component comprises a mixture of ammonium perchlorate and at least one of an alkali metal or ammonium nitrate and a metal oxide selected from the class consisting of lead, manganese, iron and copper oxides.

11. The combination of claim 10 wherein said metal oxide is manganese dioxide.

12. The combination of claim 11 wherein said oxidizer component comprises ammonium perchlorate, ammonium nitrate, and sodium nitrate.

13. The combination of claim 1 comprising at least 30 of said ignition strands.

14. The combination of claim 13 comprising from 30–50 of said ignition strands.

15. The combination of claim 14 comprising about 40 of said ignition strands within said tubular member.

16. The combination of claim 15 wherein said ignition strands comprise nitrocellulose.

17. The combination of claim 16 wherein said nitrocellulose fibers have a fuel component incorporated thereon.

18. The combination of claim 17 wherein said oxidizing agent comprises an ammonium or alkali metal perchlorate and said fuel comprises aluminum.

19. The combination of claim 18 wherein said oxidizing agent is ammonium perchlorate.

20. The combination of claim 19 wherein the weight ratio of ammonium perchlorate to aluminum is within the range of 2–4.

21. In an ignition transmission systems, the combination comprising:

a plurality of elongated tubular members which are substantially consumable under ignition conditions extending in a longitudinal conjoint relationship in which the outer surface of at least one of said tubular members at least partially overlaps and contacts another of said tubular members;

a plurality of ignition strands of oxidizable ignition material extending through each of said tubular members and providing an ignition rate for said tubular members of 3000–6000 ft/sec; and the walls of said tubular members being sufficiently thin to permit, upon ignition of the ignition strands in one of the tubular members, communication of the ignition reaction from the ignition strands of said one tubular member to the ignition strands of the other of said tubular members.

22. The combination of claim 21 comprising at least 20 of said ignition strands in each of said tubular members.

23. The combination of claim 21 comprising from 30–50 of said ignition strands in each of said tubular members.

24. The combination of claim 21 wherein said ignition strands are formed of a self-oxidizing ignition material.

25. The combination of claim 24 wherein said ignition strands comprising fibers of said self-oxidizing material having a coating thereon of a mixture of an oxidizer component and a fuel component.

26. The combination of claim 25 wherein said fibers comprise nitrocellulose and oxidizer component includes ammonium perchlorate and said fuel component includes aluminum.

27. The combination of claim 25 wherein said oxidizer component includes a metal oxide selected from the class consisting of lead, manganese, iron and copper oxides.

28. In an ignition system for an elongated propellant charge, the combination comprising:

an ignition source for said propellant charge;

a plurality of elongated ignition tubes extending from said ignition source into said propellant charge throughout a substantial longitudinal interval thereof and fanning out from said ignition source to provide a cross-sectional distribution of said tubes within said propellant charge;

each of said ignition tubes comprising an elongated tubular member having a wall thickness of no more than 0.03" and formed of a material which is substantially consumable under ignition conditions; and a plurality of strands of oxidizable ignition material extending through each of said tubular members and providing a linear ignition rate for said ignition tubes within the range of 3000–6000 ft/sec.

29. A combination of claim 28 further comprising at least 20 of said ignition strands for each of said tubular members.

30. A combination of claim 29 wherein at least some of said tubular members are provided with secondary ignition tubes bundled thereto.

31. In an ignition system for an elongated propellant charge, the combination comprising:

an ignition source for said propellant charge;

a plurality of elongated ignition tubes extending longitudinally within said propellant charge, each of said ignition tubes comprising an elongated tubular member formed of a material which is substantially consumable under ignition conditions and having a plurality of strands of oxidizable ignition material extending therethrough providing a linear ignition rate for said ignition tubes within the range of 3000–6000 ft/sec;

at least one of said tubes being a primary ignition tube connected to said ignition source and extending from said source into said propellant charge;

at least another of said ignition tubes being in a longitudinal conjoint relationship with said primary tube in which the outer surfaces of said tubes at least partially overlap and contact one another; and the walls of said primary tube and said at least another tube being sufficiently thin to permit propagation of the ignition reaction from the ignition strands in said primary tube to the ignition strands in said another tube.

32. The combination of claim 31 wherein said another ignition tube comprises a secondary ignition tube which is not directly connected to said ignition source and which with said primary ignition tube comprises a tube bundle.

33. The combination of claim 32 further comprising a plurality of said tube bundles of primary and secondary ignition tubes.

34. In a propellant cartridge and ignition system for projectile ammunition, the combination comprising:

an elongated cartridge having a breach end and a front end;

a penetrating rod extending into said cartridge from the front end thereof;

a propellant charge disposed within said cartridge and extending over said penetrating rod wherein at least a portion of said penetrating rod is embedded in said propellant charge;

an ignition source for said propellant charge located in the breach end of said cartridge;

a plurality of elongated ignition tubes extending from said ignition source into said propellant charge throughout a substantial longitudinal interval thereof and spaced from one another to provide a cross-sectional distribution of said tubes within said propellant charge which surround at least a portion of said penetrator rod; and each of said ignition tubes comprising an elongated tubular member formed of a material which is substantially consumable under ignition conditions and having a plurality of strands of oxidizable ignition material extending therethrough providing a linear ignition rate for said ignition tubes within the range of 3000–6000 ft/sec.

35. The combination of claim 34 further comprising at least 20 of said ignition strands for each of said tubular members.

36. The combination of claim 34 wherein at least some of said tubular members are provided with secondary ignition tubes bundled thereto.

* * * * *

UNITED STATES PATENT AND TRADEMARK OFFICE

CERTIFICATE OF CORRECTION

PATENT NO. : 4,917,017

DATED : April 17, 1990

INVENTOR(S) : Beltz

It is certified that error appears in the above-identified patent and that said Letters Patent is hereby corrected as shown below:

Column 3,line 59, delete "½"1" and insert therefore --½-1"--.

Signed and Sealed this

Twelfth Day of May, 1992

*Attest:*

DOUGLAS B. COMER

*Attesting Officer*

*Acting Commissioner of Patents and Trademarks*